US008901983B1

(12) United States Patent
Ruffieux et al.

(10) Patent No.: US 8,901,983 B1
(45) Date of Patent: Dec. 2, 2014

(54) TEMPERATURE COMPENSATED TIMING SIGNAL GENERATOR

(71) Applicant: Micro Crystal AG, Grenchen (CH)

(72) Inventors: David Ruffieux, Lugnorre (CH); Nicola Scolari, Lausanne (CH)

(73) Assignee: Micro Crystal AG, Grenchen (CH)

( * ) Notice: Subject to any disclaimer, the term of this patent is extended or adjusted under 35 U.S.C. 154(b) by 0 days.

(21) Appl. No.: 14/041,344

(22) Filed: Sep. 30, 2013

(51) Int. Cl.
*G04G 3/04* (2006.01)
*G04G 3/02* (2006.01)

(52) U.S. Cl.
CPC . *G04G 3/04* (2013.01); *G04G 3/022* (2013.01)
USPC ..... 327/292; 327/262; 327/513; 331/47; 331/66

(58) Field of Classification Search
CPC ..... G04G 3/022; G04G 3/04; H03B 5/04; H03L 1/00; H03L 1/022
USPC ..... 327/291, 292, 298, 299, 262, 115, 117, 327/513; 331/47, 48, 66, 70
See application file for complete search history.

(56) References Cited

U.S. PATENT DOCUMENTS 4,305,041 A * 12/1981 Frerking ..... 327/39
5,644,271 A 7/1997 Mollov et al.
5,798,667 A 8/1998 Herbert
2004/0232995 A1 11/2004 Thomsen et al.
2009/0039968 A1 2/2009 Thomsen et al.
2014/0176201 A1* 6/2014 Weltin-Wu et al. ..... 327/115

FOREIGN PATENT DOCUMENTS

EP 0 683 558 A1 11/1995

OTHER PUBLICATIONS

Search Report issued Feb. 25, 2014 in European Patent Application No. 13 18 6719.

* cited by examiner

*Primary Examiner* — Jung H Kim
(74) *Attorney, Agent, or Firm* — Oblon, Spivak, McClelland, Maier & Neustadt, L.L.P.

(57) ABSTRACT

The temperature compensated timing signal generator comprises a crystal oscillator that generates a reference time signal, and a divider circuit that receives the reference time signal as input and outputs a coarse time unit signal, the coarse time unit signal having an actual frequency deviating from a desired frequency as a function of temperature of the crystal oscillator. The signal generator also includes a high frequency oscillator configured to generate an interpolation signal having a frequency greater than the frequency of the crystal oscillator. A finite state machine computes a deviation compensating signal as a function of temperature, the signal comprises an integer part representative of an integer number of pulses to be inhibited or injected in the divider circuit and a fractional part representative of how much the output of a new time unit signal pulse should further be delayed to compensate for any remaining deviation.

11 Claims, 4 Drawing Sheets

RC 0
116
X0
112
delay time. unit DELAY del.ctr.
138
120
Counter by 32'768 inhib/inject
114
+1
K-1
nINT=np+nINTZ-1·M/P
nINT=np+nINTZ-1·
134
YES
NO
np+nINTZ-1>M/P
130
D
142
Count M(T) = number of pulses during periods of the X0
118
117
Compute fXT(M)-32'768 using poly. fit.
K=floor(fXT-32768) n=fXT-32768-K
nP=floor(n*M/P)
126
128
122
124

TEMPERATURE COMPENSATED TIMING SIGNAL GENERATOR

FIELD OF THE INVENTION

The present invention relates to temperature compensated timing signal generators. The invention more specifically concerns such timing signal generators in which pulse inhibition and/or pulse injection is used for compensating for variations of the temperature.

BACKGROUND OF THE INVENTION

Timing signal generators are known. They comprise an oscillator for providing a timing signal. The oscillator often comprises a quartz crystal resonator used to stabilize the oscillation frequency. While in principle quartz crystal oscillators are extremely accurate, it is known that their accuracy is detrimentally affected by temperature. A quartz crystal basically acts like a mechanical resonator, and any change in the temperature will cause it to expand or contract ever so slightly, thus changing the resonant frequency. In order to overcome the problems of variations in the resonant frequency, several approaches are known from the prior art.

FIG. 1 is a functional diagram of a prior art timepiece comprising a quartz crystal controlled oscillator 1, a series of binary dividers (flip-flops) 2 and a stepping motor 3 arranged to drive display means 4 of the timepiece in the form of watch-hands. In such a timepiece, the quartz crystal is often a 32,768 Hz quartz crystal tuning-fork resonator. 32,768 equals $2^{15}$. Accordingly, the dividing chain can comprise fifteen binary dividers, so that the output frequency of the chain is 1 Hz, suitable for driving the stepping motor 3.

32,768 Hz quartz crystal tuning-fork resonators are usually cut in such a way that when frequency is plotted over temperature, it defines a parabolic curve centered around 25° C. In other words, a quartz crystal tuning-fork resonator will resonate close to its nominal frequency at room temperature, but will slow down when the temperature either increases or decreases from room temperature. A common parabolic coefficient for a 32,768 Hz tuning-fork resonator is −0.04 ppm/° C.$^2$.

Timepieces equipped with a temperature sensor and capable of compensating for temperature changes are known. Patent document U.S. Pat. No. 3,895,486 describes a temperature compensated time-keeping device, as well as a temperature compensation method. This particular method known as inhibition compensation is used to lower the frequency of a timing signal. For implementing this method, the quartz crystal resonator must deliberately be made to run somewhat fast. Pulse Inhibition compensation consists in having the division chain skip a small number of cycles at regular intervals such as 10 seconds or a minute. The number of cycles to skip each time depends on the temperature and is determined by means of a programmed look-up table.

Another known method for compensating for temperature changes is pulse injection compensation. Contrarily to inhibition compensation, injection compensation works by increasing the frequency of a timing signal. As explained in patent document U.S. Pat. No. 3,978,650 for example, injection compensation consists in incorporating (injecting) additional corrective pulses into the digital signal fed through the chain of binary dividers. Again, the number of pulses to inject is determined by means of a temperature sensor and a programmed look-up table.

Both inhibition compensation and injection compensation are associated with a quantification error. The quantification error stems from the fact that it is not possible to add or suppress only a fraction of a pulse. Quantification limits the resolution to 1/f over 1 second when the frequency of the oscillator is f. If the oscillation frequency of the resonator is f=32768 Hz, the resolution is no better than 30.5 ppm, yielding an error of approximately ±15 ppm. In order to obtain a resolution of 1 ppm for example, It is necessary to compensate over at least 1 million cycles. In the case of a 32768 Hz resonator, this implies waiting at least 31 seconds before applying inhibition or injection compensation. Accordingly, with this type of compensation, the frequency of the 1 Hz output from the chain of binary dividers 2 tends to deviate slightly from its nominal frequency up to the $30^{th}$ pulse, and the accumulated error is compensated as a whole at the $31^{st}$ pulse. This is not a problem with a watch, which is a time integrating instrument. However, in the case, for example, of a timing signal generator, the accuracy of each individual pulse should be better than 1 ppm. In this case, the temperature compensation methods described above are not satisfactory. It is therefore an object of the present invention to provide a signal generator in which each individual oscillation is thermally compensated.

SUMMARY OF THE INVENTION

The present invention achieves the object cited above by providing a temperature compensated timing signal generator in accordance with the annexed claim 1.

According to the invention, the temperature compensated timing signal generator implements inhibition compensation and/or injection compensation for a coarse thermal compensation of the duration of each time unit pulse, and the signal generator further implements "fractional inhibition" as a method of interpolation allowing to correct for the quantification error associated with the inhibition and/or injection compensation.

BRIEF DESCRIPTION OF THE DRAWINGS

Other features and advantages of the present invention will appear upon reading the following description, given solely by way of non-limiting example, and made with reference to the annexed drawings, in which.

DETAILED DESCRIPTION OF THE INVENTION

Figure 3:
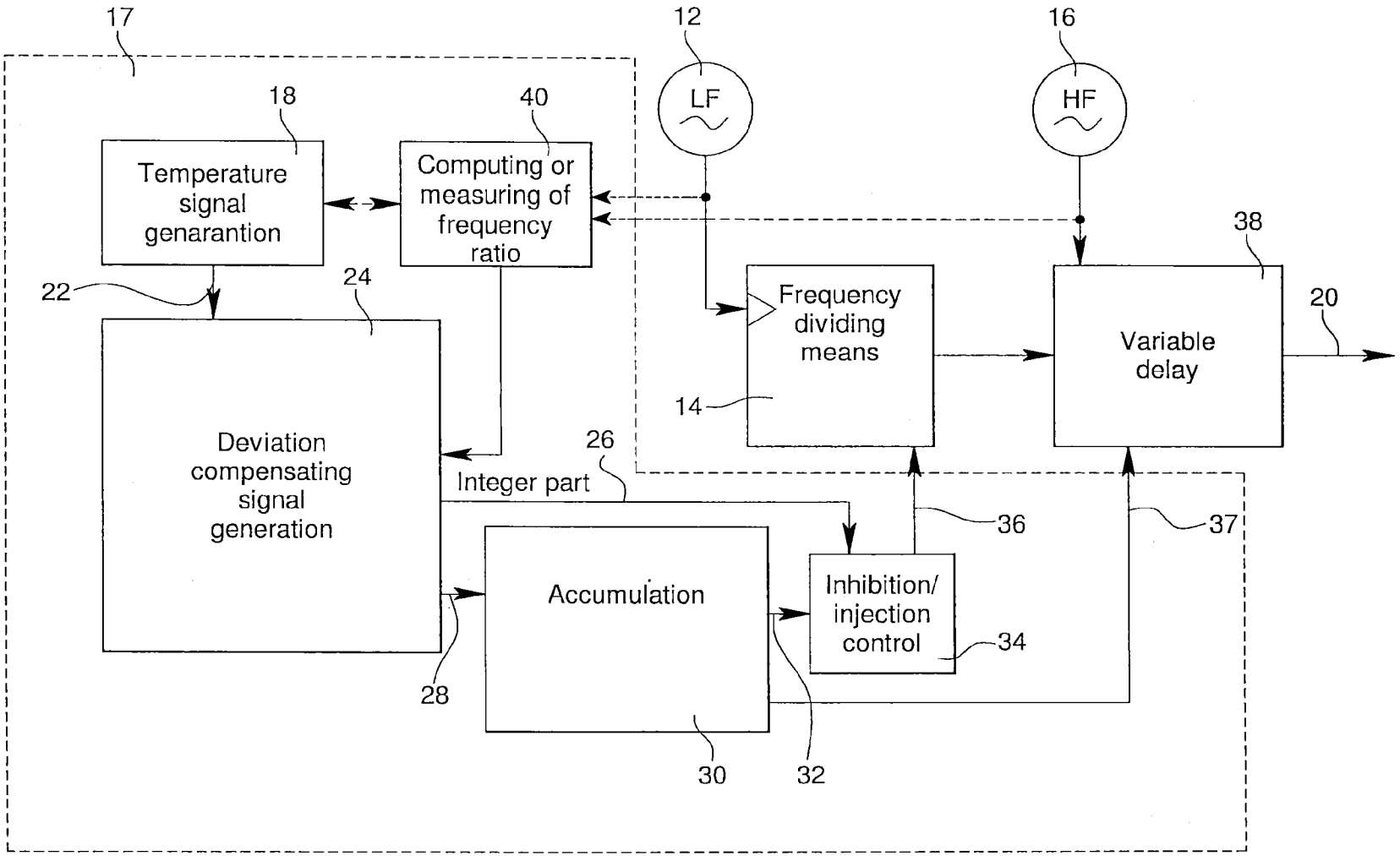
FIG. 3 is a basic functional block diagram illustrating a temperature compensated timing signal generator according to a particular embodiment of the present invention.

FIG. 3 is a block diagram illustrating a temperature compensated timing signal generator according to a first embodiment of the present invention. The timing signal generator of FIG. 3 is designed to provide a succession of temperature compensated time unit signal pulses through an output 20.

The generator comprises a crystal oscillator 12 arranged to generate a reference time signal. The crystal oscillator can be based for example on a conventional 32.768 kHz quartz crystal tuning-fork resonator. The illustrated generator further comprises a frequency divider 14 arranged to count all the oscillations of the reference time signal, and to output one clock pulse for every 32,768 oscillations of the reference time signal from the crystal oscillator.

Still referring to FIG. 3, it can be observed that the temperature compensated timing signal generator of the present invention further comprises a high frequency oscillator 16. Oscillator 16 is arranged to provide a clock signal to a block 38 representing a variable delay. The variable delay 38 is provided for compensating variations in temperature by slightly delaying the onset of edges of the timing signal. Operation of this variable delay will be described further on. The high frequency oscillator is selected to have a frequency at least six orders of magnitude greater than the frequency of the temperature compensated timing signal provided by the generator. Preferably, the frequency of the high frequency oscillator is at least $10^7$ greater than the frequency of the temperature compensated timing signal. For example, if the target frequency for the temperature compensated timing signal is 1 Hz, then the high frequency oscillator can be a 1 MHz oscillator, or preferably a 10 MHz oscillator. For example, a 10 MHz RC-oscillator integrated on a chip.

The illustrated temperature compensated timing signal generator further comprises temperature compensating means identified as a whole by reference number 17. Referring again to FIG. 3, on can see that the temperature compensating means comprises a temperature signal generation block 18 arranged to provide a signal representative of the temperature through an output 22, a deviation compensating signal generation block 24 arranged to receive both the signal from block 18 and a frequency ratio signal provided by a block 40, and to provide as outputs both an integer and a fractional deviation compensation signal, a fraction accumulation block 30 arranged to receive the fractional deviation compensation signal through an input 28 and to add it to remainders from previous fractional deviation compensation signals in order to provide a fractional inhibition command signal through an output 37 to the variable delay 38, and finally an "inhibition/injection control" block 34 arranged to receive the integer deviation compensation signal through an input 26 and to provide an inhibition/injection command signal for the frequency dividing means 14 through an output 36.

In more details, the temperature signal generation block 18 comprises a temperature sensor thermally coupled to the crystal oscillator 12. The temperature sensor is arranged to measure the temperature of the crystal oscillator. The sensor can be of any type known to the person skilled in the art. For example, the temperature sensor can be a thermistor. The sensor can also be an oscillator, the frequency of which is sensitive to the temperature. More specifically, according to a particular embodiment, the temperature sensor can be the high frequency oscillator 16. Block 18 is arranged to provide a temperature signal to block 24 through output 22. Block 24 has access to data relating to the frequency/temperature behavior of the crystal oscillator 12, and block 24 is arranged to use both this data and the temperature signal in order to provide a deviation compensating signal for compensating for temperature related deviations of the frequency of the crystal oscillator from a desired frequency. At least some of the above-mentioned frequency/temperature related data is recorded in non-volatile memory contained in block 24.

In the particular case where the temperature compensated timing signal generator of the invention is arranged to provide a time unit signal, the time unit of which is equal to 1 second, the deviation compensating signal generated by block 24 preferably corresponds to the deviation of the frequency of the crystal oscillator 12 from a nominal frequency. In the case where the temperature compensated timing signal generator of the invention is arranged to provide a time unit signal, the time unit of which is different from 1 second, the frequency of the reference time signal can advantageously be expressed as a number of oscillations per time unit, rather than as a number of oscillations per second. One should therefore understand that the deviation from the nominal frequency is preferably expressed as a number of oscillations of the crystal resonator 12. The deviation will be expressed as the combination of an integer number of oscillations of the crystal oscillator, and of a fractional rest corresponding to a remaining fraction of an oscillation of the crystal oscillator. This is the reason why the deviation compensating signal provided by the block 24 comprises both an integer part corresponding to an integer number of pulses of the crystal oscillator to be inhibited or injected into the frequency divider 14, and fractional part intended to compensate for any remaining deviation. One will further understand that, in the case where the frequency of the crystal oscillator is higher than the nominal frequency, the integer part of the deviation is to be compensated for by pulse inhibition and the fractional part by fractional inhibition. On the other hand, in the case where the frequency of the crystal oscillator is lower than the nominal frequency, the integer part of the deviation is to be compensated for by pulse injection, while the fractional part is always compensated for by fractional inhibition. Whether integer or fractional, inhibition can never increase the frequency of the timing signal. Therefore, in the case where the frequency of the crystal oscillator is lower than the nominal frequency, the integer number of pulses injected into the frequency divider should be large enough to increase the frequency of the timing signal to at least the desired height. Fractional inhibition can then be used to slightly lower the frequency so as to remove any over compensation due to the quantification error. In other words, depending on whether the frequency of the crystal oscillator is higher or, on the contrary, lower than the nominal frequency, the integer part and the fractional part of the deviation compensating signal should be combined differently. In the first case, where the frequency of the crystal oscillator is higher than the nominal frequency, the deviation should preferably be expressed as the sum of an integer number of pulses to inhibit and of a fractional rest corresponding to fractional inhibition, while in the second case, where the frequency of the crystal oscillator is lower than the nominal frequency, the deviation is preferably expressed as an integer number of pulses from which a fractional rest is subtracted.

Block 24 is arranged to provide the integer part of the deviation compensating through output 26 and to provide the fractional part of the deviation compensating signal through output 28. According to the invention, the fractional part of the deviation compensating signal is further converted into an equivalent number of periods of the high frequency oscillator 16. As the oscillation period of the high frequency oscillator 16 is many times smaller than the oscillation period of the crystal oscillator 12, the converted value of the fractional part of the deviation compensating signal generally exceeds several periods of the high frequency oscillator. Therefore, the converted fractional part of deviation compensating signal can be rounded to an integer number periods of the high frequency oscillator without losing significantly on precision.

According to one embodiment, the deviation compensating signal generation block 24 contains a look-up table preloaded with deviation values corresponding to a selected temperature range. Based on a temperature signal received by block 24, the look-up table provides an integer deviation compensating signal through output 26 and a fractional deviation compensating signal through output 28. As previously mentioned, the fractional deviation compensating signal is expressed as an integer number of periods of the high frequency oscillator 16. Expressing the deviation in this way, in terms of the period of the high frequency oscillator, requires knowing the relation between the frequencies of the two oscillators 12 and 16. According to the illustrated example, a frequency ratio signal corresponding to the ratio between the frequencies of crystal oscillator 12 and high frequency oscillator 16 is available to block 24 from block 40. Block 24 uses this ratio in order to convert the fractional deviation compensating signal, corresponding to a fraction of a period of the crystal oscillator 12, into a corresponding integer number of periods of the high frequency oscillator 16.

The person skilled in art will understand that there are numerous ways in which block 40 can determine the frequency ratio. According to different embodiments, block 40 may determine the ratio between the frequencies of the crystal oscillator 12 and the high frequency oscillator 16 by counting the number of pulses from the high frequency oscillator within an oscillation period of the crystal oscillator, or by using a look-up table preloaded with values of the ratio for different temperatures in a given temperature range.

Output 28 of block 24 is arranged to provide the fractional part of a new deviation compensating signal to fraction accumulation block 30 during each pulse of the temperature compensated timing signal (provided through output 20). The fractional part of the new temperature compensating signal is added to the cumulative amount of fractions of deviation compensating signals already in the fraction accumulation block 30. One will understand that, as the fractional part of the deviation compensating signal is expressed as an integer number of periods of the high frequency oscillator 16, the state of fraction accumulation block is a value corresponding to a cumulative number of periods of the high frequency oscillator. Whenever the cumulative number of periods of the high frequency oscillator grows to over one period of the crystal oscillator 12, exactly one period of the crystal oscillator is deducted from the contents of the fraction accumulation block. In this way, the fractional inhibition command signal provided by fraction accumulation block 30 always corresponds to less than one unit of the integer part of the deviation compensating signal. Any whole period of the crystal oscillator deducted from the contents of the fraction accumulation block 30 is transferred through output 32 to the inhibition/injection control block 34, where it is merged (added or subtracted) with the integer part of the deviation compensating signal in order to constitute the inhibition/injection command signal. One should understand however, that according to alternative embodiments of the invention, it would be possible to let the cumulative number of periods contained in the fraction accumulation block grow to the equivalent of several periods of the crystal oscillator 12 before deducting those periods from the contents of the fraction accumulation block.

The inhibition/injection control block 34 is arranged to correct the state of the frequency dividing means 14 once every period of the temperature compensated timing signal. It is known to the person skilled in the art that either inhibition or injection can provide temperature compensation. However, as explained in the introduction the temperature compensation obtained through inhibition or injection is coarse (i.e. has a limited resolution), and it is a goal of the present invention to allow for temperature compensation with a finer resolution. The present invention achieves this goal by further using the fractional part of the deviation compensating signal in order to control the variable delay 38 so as to implement a second finer temperature compensation.

According to the illustrated embodiment, variable delay 38 is, for example, a digital counter configured to receive the fractional inhibition command signal from fraction accumulation block 30 as input, and to count down to zero before generating an output signal. One should note that, on the one hand, the variable delay 38 is clocked by the high frequency oscillator 16, and that on the other hand, the fractional inhibition command signal is expressed as an integer number of periods of the high frequency oscillator 16. Therefore, one will understand that the illustrated embodiment of a temperature compensated timing signal generator according to the invention allows compensating for temperature up to a precision equal to a period of the high frequency oscillator 16. If for example the target frequency for the temperature compensated timing signal is 1 Hz, and the high frequency oscillator is a 1 MHz oscillator, then the frequency resolution will be 1 ppm.

Figure 4:
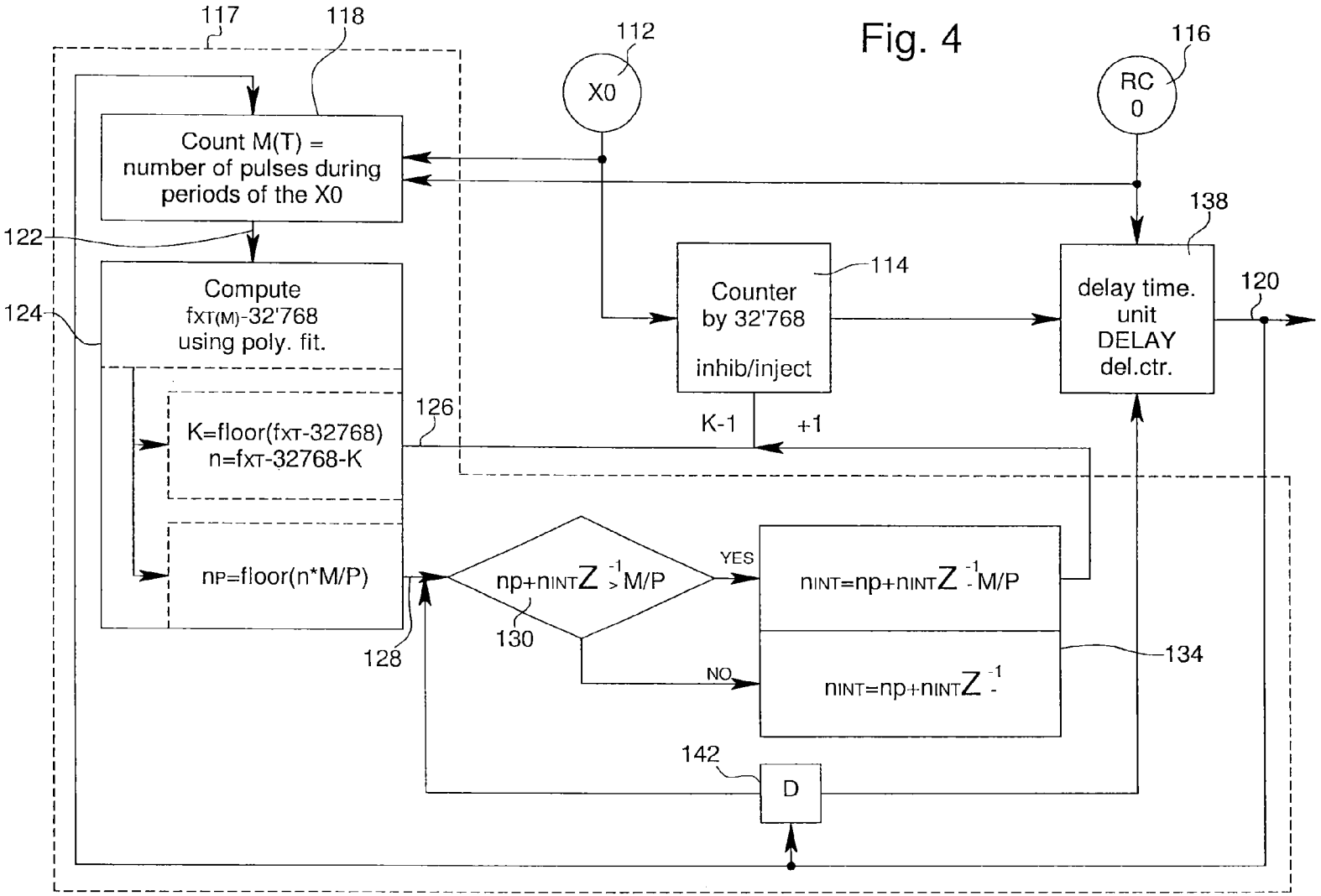
FIG. 4 is a detailed functional block diagram illustrating an alternative implementation of the temperature compensated timing signal generator of FIG. 3.

FIG. 4 is a functional block diagram illustrating a temperature compensated timing signal generator corresponding to an alternative implementation of the embodiment of the present invention shown in FIG. 3. According to this alternative implementation, the timing signal generator of the invention takes the form of an accurate 1 pulse per second timing signal generator. The generator of FIG. 4 is designed to provide a temperature compensated 1 Hz timing signal through an output 120. The generator comprises a 32.768 kHz crystal oscillator 112 based on a conventional quartz crystal tuning-fork resonator. The illustrated generator further comprises a counter 114 arranged to count all the oscillations from the crystal oscillator 112, and to output a clock pulse every time that it counts to 32,768 crystal oscillations. The counter is then reset for starting the next one second (i.e. 32.768) count. The timing signal generator further comprises a 10 MHz RC-oscillator 116. Oscillator 116 is arranged to provide a clock signal to a variable delay block 138. Variable delay block 138 is provided for compensating variations in temperature. Operation of the variable delay will be described further on.

The temperature compensated timing signal generator illustrated in FIG. 4 also comprises temperature compensating means identified as a whole by reference number 117. The illustrated temperature compensating means is made up of functional blocks 118, 124, 130, 134 and 142. Functional block 118 receives the output signals from the crystal oscillator 112 and the RC-oscillator 116. Block 118 is arranged for counting a number (M) of pulses of the RC-oscillator 116 falling within a predetermined number (P) of oscillation periods of the crystal oscillator 112. For example, functional block 118 can be implemented with a pair of counters arranged to count the pulses from the two oscillators. As soon as one of the counters has counted P pulses from the crystal oscillator, the other counter stops counting the pulses from the RC-oscillator. The state of the second counter when it is stopped is the pulse count M. M is an integer that depends on the temperature (T) of the two oscillators. Functional block 118 is arranged to compute M(T) once every period of the temperature compensated timing signal. Therefore, a new value for the count M(T) is computed every second. Furthermore, the RC-oscillator 116 is in thermal contact with the crystal oscillator 112. Therefore, the two oscillators have the same temperature T.

Figure 1:
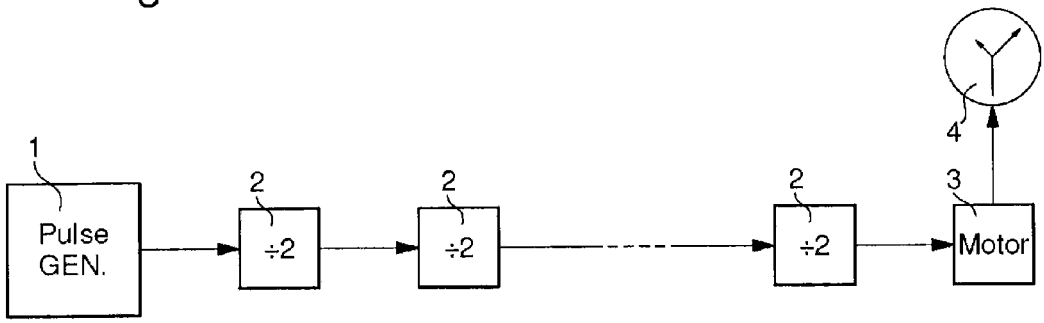
Fig. 1 Prior Art
FIG. 1 is basic functional diagram of a prior art clock comprising a time base and a frequency divider, as well as a motor and time indicating means actuated by the frequency divider.
Figure 2:
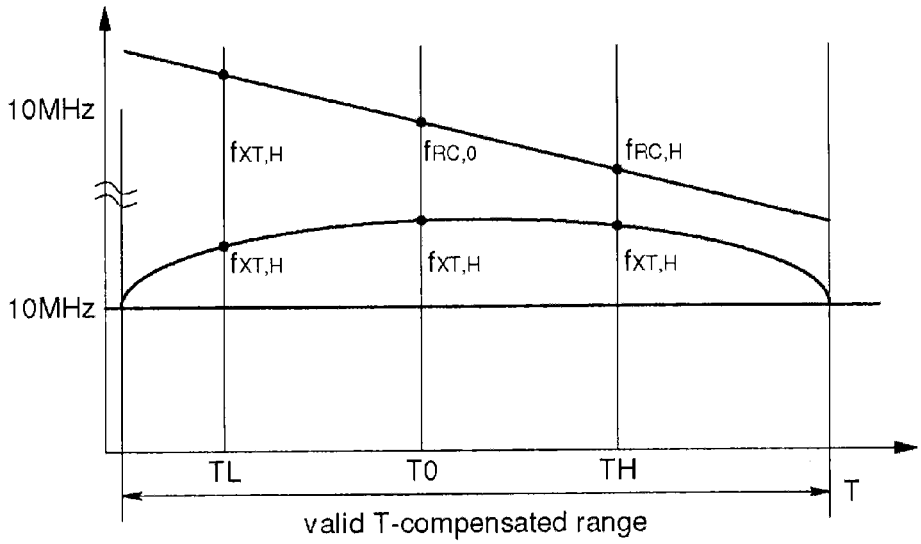
FIG. 2 is a diagram showing temperature dependency of the frequencies of a quartz crystal tuning fork resonator and of a RC-oscillator.

FIG. 2 is a diagram showing on the one hand a typical temperature dependency curve for the frequency $f_{XT}$ of a crystal oscillator comprising a quartz crystal tuning fork resonator, and on the other hand, a typical temperature dependency curve for the frequency $f_{RC}$ of a RC-oscillator. Although the horizontal and vertical scales of the diagram are not the same, it can be seen that the rate of variation with temperature of the frequency $f_{RC}$ of the RC-oscillator 116 is generally considerably larger than the rate of variation of the frequency $f_{XT}$ of the crystal oscillator 112. Furthermore, the variation of the frequency of an RC-oscillator with temperature is substantially linear. It follows that the oscillators can be chosen so that the relation between the count M(T) and the temperature T is univocal (unambiguous) within a predefined operating range. The count M(T) computed in functional block 118 can thus be used as a temperature signal. The pulse count M(T) can be computed with the following equation (1):

$$M(T)=\text{floor}(P*f_{RC}/f_{XT}); \quad (1)$$

where the frequencies $f_{RC}$ and $f_{XT}$ both depend on the temperature T (the "floor", "ceiling" and "sawtooth" functions used in the present application are defined in Wikipedia in the entry "floor and ceiling functions". This entry is incorporated by reference).

It is worthwhile to note that functional block 118 of FIG. 4 can be considered as a particular implementation of the temperature signal generation block 18 of FIG. 3.

The temperature signal M(T) is provided to the deviation compensating signal generation block 124 through an output 122 of functional block 118. According to the illustrated example, the deviation compensating signal generation block 124 comprises a finite state machine configured with calibration data so as to provide a deviation compensating signal for any value of the temperature signal M(T) within a predefined operating range. Once calibrated, the finite state machine is capable of computing the deviation of the quartz crystal oscillator 112 (Deviation=$f_{XT}$−32,768) for any new value of M(T) within the operating range. Deviation compensating signal generation block 124 is arranged to provide a new deviation compensating signal once for every 1 Hz temperature compensated timing signal. In other words, a new value of the deviation compensating signal is provided for each new count M(T).

Configuring the finite state machine can be quite simple. Indeed, it is well known that the frequency-temperature behavior of tuning-fork quartz crystal resonators closely approximates a parabola. It follows that it is possible to predict the behavior of the crystal oscillator 112 with reasonably good accuracy by a simple second degree polynomial fit. The advantage of computing a polynomial fit instead of using a preloaded look-up table is that a polynomial fit requires preloading the values of temperature signal M(T) and of the frequency $f_{XT}$(M) for only three different temperatures $T_L$, $T_0$ and $T_H$ (shown in FIG. 2). Furthermore, as previously mentioned, according to the present example, the nominal frequency is 32,768 Hz or, expressed differently, $2^{15}$ Hz. This means that the nominal frequency of the quartz crystal resonator can further be expressed as the binary number 1,000,000,000,000,000. It follows that in binary notation, the decimal frequency deviation $f_{XT}$−32,768 becomes $f_{XT}$−1,000,000,000,000,000. As the temperature related frequency deviation is small in comparison to the nominal frequency, the modulus of the binary frequency deviation should have non-zero digits only among the digits with the least weight. An advantage associated with this feature is that it allows to choose a simpler algorithm to compute the frequency deviation, and therefore reduces the amount of computing power that is needed.

It is important to note that, the deviation compensating signal generation block 124 computes not only the integer part of the frequency deviation (designated hereinafter by the letter "K"), but also computes a fractional component of the deviation (designated hereinafter by the letter "n"), up to a predefined number of fractional binary places. It follows that, in the case where $f_{XT}$−32,768>0, the total frequency deviation is equal to K+n, where 0<n<1. K and n can be computed with the two following equations (2) and (3) respectively:

$$K=\text{floor}(f_{XT}-32{,}768) \text{ (and } K \text{ is a positive integer or zero)} \quad (2)$$

$$n=f_{XT}-32{,}768-K \ (0\leq n<1) \quad (3)$$

Furthermore, in the case where $f_{XT}$−32,768<0, K and n can be computed with the two same equations:

$$K=\text{floor}(f_{XT}-32{,}768) \text{ (however } K \text{ is a negative integer)} \quad (2')$$

$$n=f_{XT}-32{,}768-K \ (0\leq n<1 \text{ is always true}) \quad (3')$$

and the total frequency deviation is always equal to K+n (when K is negative, it means that pulse injection should be used instead of pulse inhibition). Similarly to what was described in relation to the embodiment of FIG. 3, functional block 124 further converts n (the fractional part of the deviation compensating signal) into an equivalent number np of periods of the RC-oscillator 116. As the oscillation period corresponding to 1 MHz is many times smaller than the oscillation period corresponding to 32.768 kHz, the converted value np of the fractional part n of the deviation compensating signal generally exceeds several periods of the RC-oscillator. Therefore, np can be rounded to an integer number periods without losing too much precision. "np" can be computed with the following equation (4):

$$np=\text{floor}(n*M/P) \quad (4)$$

where M is M(T) computed by functional block 118 and P is the number of oscillation periods of the crystal oscillator 112 over which M is counted.

As already explained in relation to FIG. 3, np basically corresponds the number of periods of the RC-oscillator during which the onset of a new pulse of the temperature compensated 1 Hz timing signal should be delayed in order to compensate for temperature. However, one will understand that if a particular pulse of the 1 Hz signal is delayed, the following pulses must also be delayed (or else the next pulse will be to short). Therefore, the delay should take into account both np and the value of the delay for the previous pulse. Still referring to FIG. 4, it can be seen that output 128 of block 124 is arranged to provide the fractional part np of a new deviation compensating signal to diamond shaped functional block 130. Functional block 130 works as an accumulator, in which the value np of the fractional part of the new deviation compensating signal is added to the value $n_{INT}$ corresponding to the previous fractional inhibition command signal. The previous fractional inhibition command signal value $n_{INT}$ is provided by functional block 142. For example, functional block 142 can be a register made up of D flip-flops.

In conjunction with functional block 134, functional block 130 is further arranged to make the following decision:

$$\text{If } np+n_{INT}\leq M/P \text{ then } n_{INT}'=np+n_{INT}-M/P$$

$$\text{else } n_{INT}'=np+n_{INT}$$

where $n_{INT}'$ is the new fractional inhibition command signal and corresponds to the number of periods of the RC-oscillator during which the onset of a new pulse of the temperature compensated 1 Hz timing signal should be delayed in order to compensate for temperature; M is M(T) computed by functional block 118, and the ratio M/P corresponds to the length of one period of the crystal oscillator 112 expressed in units equal to the period of the RC-oscillator.

One will understand from the above that functional blocks 130 and 134 operate in such a way that $n_{INT}$ is always smaller than M/P. Furthermore, M/P corresponds to the duration of one period of the crystal oscillator 112, therefore, any quantity M/P subtracted from the accumulated fractional parts of the deviation compensating signal can be immediately added as 1 additional unit to the integer part of the deviation compensating signal K−1 through functional block 134. In other words, whenever the quantity M/P is subtracted from the accumulated fractional parts of the deviation compensating signal a unit is added to the integer part of the deviation compensating signal so that its value is changed from K−1 to K.

The integer part K of a new deviation compensating signal is available for correcting the state of the frequency dividing means 14 once every period of the 1 Hz temperature compensated timing signal. According to the illustrated embodiment, the integer part K of the deviation compensating signal corresponds to the number of 32.768 kHz pulses of the crystal oscillator 112 that should be inhibited during a particular period of the Hz temperature compensated timing signal. As explained in the introduction, pulse inhibition compensation, like pulse injection compensation, can provide a resolution of no better than 30.5 ppm. As previously explained, in order to achieve a resolution as good as 1 ppm, the present invention also uses the fractional part of the deviation compensating signal np in order to control the variable delay 138 so as to implement a second level of temperature compensation with a much finer resolution.

As in the previous example, variable delay 138 can be, for example, a digital counter clocked by the RC-oscillator 116 and configured to receive the fractional inhibition command signal $D_{INT}'$ provided by the functional block 134. As $D_{INT}'$ is expressed in units equal to the oscillation period of the RC-oscillator, the variable delay 138 allows for compensating for temperature up to a precision equal to a period of the 10 MHz RC-oscillator, that is $10^{-7}$ seconds.

Figure 5:
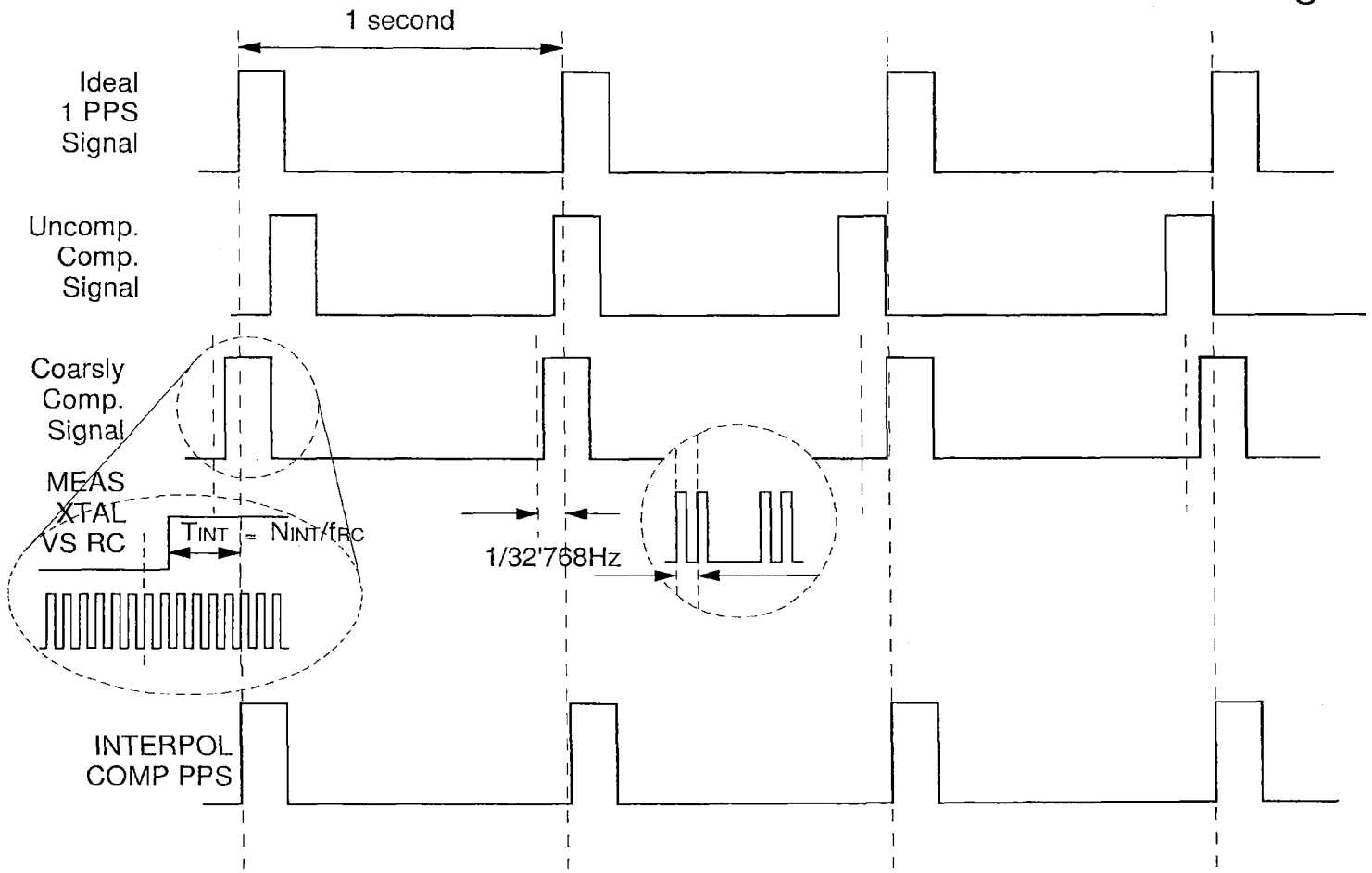
FIG. 5 is a timing diagram showing the effect of temperature compensation on the timing signal provided as output by the timing signal generator of FIG. 4.

FIG. 5 is a timing diagram showing the effect of temperature compensation on the timing signal provided as output by the timing signal generator of FIG. 4. Referring to FIG. 5, the first line shows an ideal 1 pulse per second (1 pps) signal that might be produced by a perfectly compensated timing signal generator. The ascending edges of the ideal pulses shown in the figure are labeled i1, i2, i3 and i4 respectively. The double headed arrow situated between edges i1 and i2 represents the oscillation period T (1 second in the example).

The second line of FIG. 5 shows the actual pulses that would be delivered by functional block 114 of FIG. 4 in the absence of any temperature compensation. The frequency of the uncompensated signal of line 2 is equal to the frequency of the crystal oscillator 112 divided by 32,768. As can be seen, the uncompensated signal deviates markedly from the ideal signal. This deviation is generally due partly to the way the resonator was made, and partly to variations in the ambient temperature. As can be seen in FIG. 5, the uncompensated signal is actually fast compared to the ideal signal. Indeed, as both pulse inhibition and delay have the effect of slowing the frequency, the tuning-fork quartz crystal resonator in oscillator 112 of FIG. 4 must be made to be too fast. One should note however that, in embodiments where the temperature compensation uses both pulse inhibition and pulse injection, there is no such requirement that the resonator be too fast.

Line 3 of FIG. 5 shows the actual pulses that are delivered by functional block 114 when pulse inhibition is used for a coarse temperature compensation. Coarse temperature compensation by pulse inhibition as shown on the third line is known. Pulse inhibition has the effect of lowering the frequency, thus bringing the frequency closer to the ideal frequency. However, pulse inhibition can only delay the onset of the next pulse by multiples of the oscillation period of the crystal oscillator; that is approximately 1/32,768 Hz, or in other words, 31 μs. The resolution is therefore about 30 ppm.

Line 4 of FIG. 5 shows the temperature compensated timing signal delivered by the timing signal generator of FIG. 4. As can be observed, the temperature compensated timing signal is almost perfectly synchronized with the ideal 1 pps signal of the first line. The variable delay is capable delaying the onset of the next pulse with a resolution equal to the oscillation period of the RC-oscillator; that is approximately $1/10^7$ s., or in other words, 0.1 μs. The resolution is therefore about 0.1 ppm.

One advantage of the described temperature compensated timing signal generator is that it can have a very low energy consumption. Indeed, except for the high frequency oscillator, the components of the timing signal generator require very little power. Therefore, according to a preferred embodiment of the invention, in order to save energy, the high frequency oscillator is shut down for the major part of each time unit, and is turned on only when it is needed.

More specifically, applying this way of doing to the particular example illustrated in FIG. 4, it can be observed that when an oscillator like the 10 MHz RC-oscillator 116 of FIG. 4 is turned on, it needs approximately 120 μs for the frequency to stabilize. Once the oscillations have stabilized, the operation of counting the number of pulses M(T) of the RC-oscillator during P periods of the crystal oscillator is typically carried out during about 1,000 μs. Finally, implementing the fractional inhibition requires only a handful of periods of the RC-oscillator. The RC-oscillator therefore typically operates for 1.1 milliseconds during every second. This corresponds to a duty cycle of approximately 1/900. Power consumption of the RC-oscillator can thus be reduced in the same proportion.

Finally, one should understand that it is not a problem if the high frequency oscillator of FIG. 3 or the RC-oscillator of FIG. 4 have deviated substantially from its nominal frequency. Indeed, the frequency ratio M/P is updated regularly, preferably once during each period of the temperature compensated timing signal.

The invention claimed is:

1. A temperature compensated timing signal generator for generating a succession of temperature compensated time unit signal pulses, said time unit of the signal pulses being an arbitrary predefined time interval, the timing signal generator comprising:

a crystal oscillator configured to generate a reference time signal, and a divider circuit arranged to receive the reference time signal as input and to output a coarse time unit signal, the reference time signal and the coarse time unit signal each having an actual frequency deviating from a corresponding desired frequency as a function of the temperature of said crystal oscillator;

a high frequency oscillator configured to generate an interpolation signal having a frequency ($f_{RC}$) greater than a frequency ($f_{XT}$) of the crystal oscillator, wherein the frequency of the crystal oscillator is the same as the frequency of the reference time signal;

a temperature signal generation circuit comprising a temperature sensor in thermal contact with the crystal oscillator and configured to provide and refresh periodically a digital temperature signal representative of the temperature of said crystal oscillator;

a finite state machine configured with calibration data so as to compute for each time unit signal pulse, as a function of the digital temperature signal, a deviation compensating signal comprising an integer part representative of an integer number of pulses to be inhibited or injected in the divider circuit and a fractional part representative of how much the output of a new time unit signal pulse should further be delayed in order to compensate for any remaining deviation;

a coarse compensation circuit arranged to receive the integer part of each new deviation compensating signal and for injecting or inhibiting a number of pulses of the reference time signal in the divider circuit for each time unit signal pulse, said number of pulses depending on said integer part of the deviation compensating signal;

a frequency conversion circuit arranged to provide and refresh periodically a digital frequency ratio signal representative of a ratio (M/P) of the frequency of the high frequency oscillator over the frequency of the crystal oscillator, and further arranged for converting the fractional parts (n) of deviation compensating signals corresponding to each time unit signal pulse into corresponding numbers (np) of periods of the interpolation signal;

a fraction accumulation circuit arranged to receive, for each time unit signal pulse, a new one of said numbers of periods (np) of the interpolation signal, and to compute iteratively a new fractional inhibition command signal ($n_{INT}'$) by adding said new one of said numbers of periods (np) of the interpolation signal to a previous fractional inhibition command signal ($n_{INT}$); and a variable delay circuit arranged to receive each new fractional inhibition command signal ($n_{INT}'$) and to delay the output of the next time unit signal pulse for the duration of a corresponding number of periods of the interpolation signal.

2. The temperature compensated timing signal generator of claim 1, wherein, if said new fractional inhibition command signal ($n_{INT}'$) equals no less than one period of the crystal oscillator (M/P), one period of the crystal oscillator (M/P) is deducted from said new fractional inhibition command signal and one unit is added to the integer part (K) of the deviation compensating signal.

3. The temperature compensated timing signal generator of claim 1, wherein the high frequency oscillator has a frequency ($f_{RC}$) at least $10^6$ times as great as the frequency of the temperature compensated time unit signal pulses.

4. The temperature compensated timing signal generator of claim 1, wherein the crystal oscillator comprises a 32,768 Hz tuning-fork quartz crystal resonator.

5. The temperature compensated timing signal generator of claim 1, wherein the frequency of the temperature compensated time unit signal pulses is 1 Hz.

6. The temperature compensated timing signal generator of claim 1, wherein the high frequency oscillator is an RC-oscillator integrated on a chip and having a frequency ($f_{RC}$) of at least 1 MHz.

7. The temperature compensated timing signal generator of claim 6, wherein the high frequency oscillator has a frequency of at least 10 MHz.

8. The temperature compensated timing signal generator of claim 1, wherein, if the frequency ($f_{XT}$) of the reference time signal is higher than the corresponding desired frequency, the integer part (K) of the deviation compensating signal is equal to the largest integer not greater than the absolute value of the frequency deviation and corresponds to an integer number of pulses to be inhibited in the divider circuit, and the fractional part (n) of the deviation compensating signal is equal to the absolute value of the fractional part of the frequency deviation.

9. The temperature compensated timing signal generator of claim 1, wherein, if the frequency of the reference time signal is lower than the corresponding desired frequency, the integer part (K) of the deviation compensating signal is equal to the smallest integer not less than the absolute value of the frequency deviation and corresponds to an integer number of pulses to be injected into the divider circuit, and the fractional part (n) of the deviation compensating signal is equal to 1 minus the absolute value of the fractional part of the frequency deviation.

10. The temperature compensated timing signal generator of claim 1, wherein the high frequency oscillator is arranged to be operated intermittently once every time unit, and wherein the variable delay circuit is configured to use the high frequency oscillator, in order to adjust delay of the onset of the next time unit signal pulse, once every time unit, after the high frequency oscillator has been started and given enough time to stabilize and before the high frequency oscillator is stopped again.

11. The temperature compensated timing signal generator of claim 10, wherein the frequency conversion circuit refreshes the digital frequency ratio signal during a recurrent second time interval occurring once every time unit, outside a first time interval, after the high frequency oscillator has been started and given enough time to stabilize and before the high frequency oscillator is stopped again.

* * * * *